United States Patent [19]

Penner et al.

[11] Patent Number: 4,697,524

[45] Date of Patent: Oct. 6, 1987

[54] AFTER-FIRING SAFETY

[75] Inventors: Horst Penner; Ernst Jensen, both of Fürth, Fed. Rep. of Germany

[73] Assignee: Dynamit Nobel Aktiengesellschaft, Troisdorf, Fed. Rep. of Germany

[21] Appl. No.: 819,290

[22] Filed: Jan. 16, 1986

[30] Foreign Application Priority Data

Jan. 17, 1985 [DE] Fed. Rep. of Germany ..... 3501450

[51] Int. Cl.[4] ..... F42B 13/20

[52] U.S. Cl. ..... 102/498; 102/228

[58] Field of Search ..... 102/445, 498, 228, 230, 102/247, 248, 251, 257, 269, 529

[56] References Cited

U.S. PATENT DOCUMENTS

| | | | |
|---|---|---|---|
| 3,422,764 | 1/1969 | Kaiser | 102/269 |
| 4,553,482 | 11/1985 | Weber et al. | 102/529 |

FOREIGN PATENT DOCUMENTS

| | | | |
|---|---|---|---|
| 530432 | 1/1955 | Belgium | 102/230 |
| 304258 | 5/1920 | Fed. Rep. of Germany | 102/257 |
| 1428801 | 4/1969 | Fed. Rep. of Germany . | |
| 3033061 | 4/1982 | Fed. Rep. of Germany | 102/498 |
| 1558042 | 1/1969 | France . | |
| 2280878 | 2/1976 | France . | |
| 426556 | 6/1967 | Switzerland . | |

*Primary Examiner*—Harold J. Tudor

*Attorney, Agent, or Firm*—Antonelli, Terry & Wands

[57] ABSTRACT

An after-firing safety mechanism of a training ammunition that is fired through the central barrel of a full-caliber dummy projectile is described. The training ammunition includes a primer igniting an active charge upon impingement of the training ammunition on the target, as well as a locking pin ejectable perpendicularly to the axis of the training ammunition, this pin fixing the primer in place at least as long as the training ammunition is within the barrel of the dummy projectile. The locking pin is inserted in this arrangement in a cavity, to be ejectable by gas pressure. The cavity is in communication with a pyrotechnical gas generator; the latter being connected to an ignition system operating with delay. This ignition system is initiated upon firing of the training ammunition from the barrel of the dummy projectile.

8 Claims, 1 Drawing Figure

AFTER-FIRING SAFETY

Figure 1:
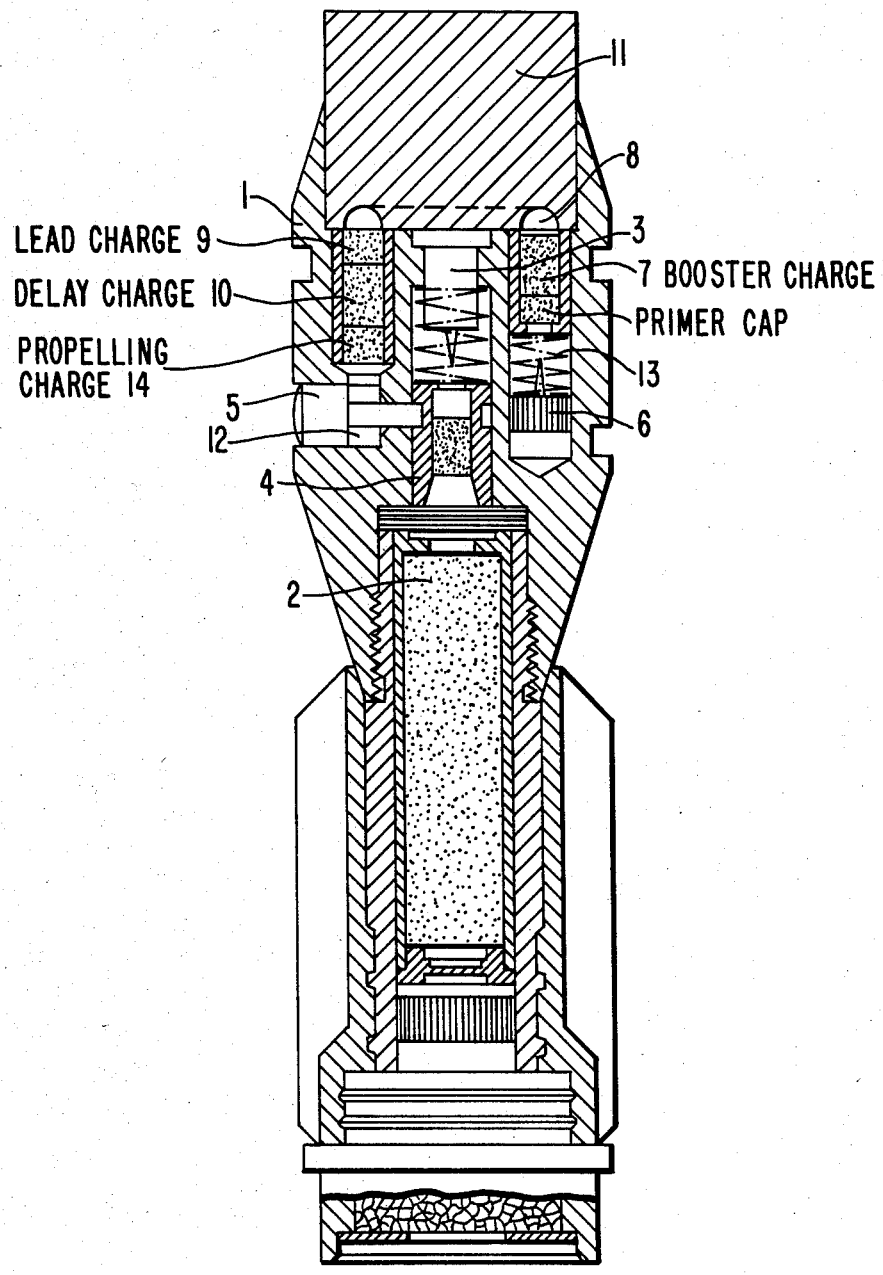

This invention relates to an arming delay safety mechanism (which provides safety in front of the barrel) for training ammunition, fired through the central barrel of a full-caliber dummy projectile.

German Pat. Nos. 1,207,833, 1,216,156, 1,277,706, 1,453,821, 1,678,492 and DOS 3,033,061 disclose subcaliber training ammunition for mortars. In these systems, this ammunition is fired through a barrel installed centrally in a full-caliber dummy mortar projectile. In order to be able to observe impingement of the training ammunition in the target, the training projectile contains an active charge, frequently a smoke-producing signaling charge ignited by a fuze or igniter when hitting the target area, this fuze, consists in a system of percussion type primer cap and booster charge, being initiated by means of a striker pin upon impact.

In order to avoid improper triggering of the explosive train during transport and during handling of the ammunition, DOS 3,033,061 suggests to secure the fuze by means of a locking pin. The locking pin is inserted in the projectile; i.e., the training ammunition, perpendicularly to the projectile axis and engages, with its end on the inside of the projectile, into a corresponding recess in the fuze, so that the fuze cannot be moved toward the striker pin lying in opposition thereto. The end of the locking pin on the outside of the projectile is flush with the outer surface of the projectile coming into contact with the wall of the barrel. In the projectile, a spring is attached to the locking pin in such a way that the pin is urged radially outwardly. As soon as the projectile has left the barrel in the dummy mortar projectile, the locking pin is no longer in contact with the inner wall of the barrel and thus is ejected. Thereby, the fuze becomes freely movable so that the explosive train is in the live position. In case of contact with obstacles in the flight path, the active charge will then be immediately triggered. If this happens in the area close to the barrel mouth, then the person firing the projectile is endangered thereby, inasmuch as the projectile is armed directly after leaving the barrel.

Starting with the heretofore described state of the art, it is an object of the present invention to provide an arming delay mechanism wherein the active charge can be ignited only once the projectile has safely moved out of the range of the proximity of the gun or firing device.

This object has been attained, in an arming delay mechanism for training ammunition fired through the central barrel of a full-caliber dummy projectile, with a fuze which ignites an active charge upon impact of the training ammunition on the target, with a locking pin ejectable perpendicularly to the projectile axis which pin fixes the fuze in position at least as long as the training ammunition remains in the barrel, by the features that the locking pin is inserted, ejectable by gas pressure, in a cavity in communication with a solid propelling charge, and that the propelling charge is connected to an ignition train operating with delay, this system being initiated during firing of the training ammunition.

This arrangement ensures that the fuze is rendered to be live at an exactly definable point in time, after the projectile has left the barrel. This is attained simply by adjusting the time delay of the ignition train operating with delay. Moreover, the assembly of the training ammunition is also simpler and safer than has heretofore been the case.

Preferably, the ignition train comprises a pyrotechnical delay charge. Thereby, an exactly definable delay period is predetermined in a simple way.

Preferably, a lead charge is arranged in front of the delay charge, this lead charge being ignited with primer cap with booster charge initiated by a striker pin by the firing acceleration. In a preferred embodiment, the primer cap with booster charge is arranged to be movable against the force of a spring in the direction toward the striker pin. On its side in opposition to the striker pin, the primer cap with booster charge is in communication with a transmission channel leading to the booster charge.

An especially compact structure is obtained if the axes of symmetry of the locking pin, of the propelling charge, and of the ignition train lie in a plane extending through the axis of the training projectile. The locking pin, the propelling charge, the delay charge, and the lead charge are located on one side of the longitudinal axis of the projectile; the primer cap with booster charge, the spring, and the striker pin lie on the other side of the longitudinal projectile axis. This bilaterally symmetrical structure permits an especially economical and inexpensive manufacture, specifically if the enumerated components each exhibit round cross sections since, in such a case, essentially only three bores, different from one another, must be provided.

Another simplification in production results if the training ammunition is equipped with an optionally exchangeable tip (according to German Pat. No. 1,453,821), and the transmission channel is worked into the end of the tip on the inside of the projectile, as an annular duct with a half-round cross section.

Further preferred embodiments can be seen from the example described in greater detail below with reference to the single figure of the drawings.

The single FIGURE shows a longitudinal section through the axis of symmetry of a training projectile inserted in the barrel, not shown herein, pertaining to a full-caliber dummy mortar projectile.

The projectile contains, in its rearward portion, an active charge 2, a fuze being arranged thereabove. The fuze 4 (with the locking pin being released) is movable in a central bore toward a head member 11 inserted in the tip 1 of the projectile at the forward end of the projectile, and this takes place against the bias of a spring. A striker pin 3 is located at a certain spacing above the fuze 4. Upon impact of the projectile on the target, the fuze 4 moves forward, hits the striker pin 3, is thereby initiated, and ignites the active charge 2.

In the position illustrated in the figure, where the training projectile is still within the barrel, the inner end of a locking pin 5 is seated in an annular recess of the fuze 4. The locking pin 5 exhibits a piston-like head located on the outside of the projectile, a cylindrical shank following the head. The end of the cylindrical shank is seated in the recess of the fuze 4. The locking pin 5 is sealingly inserted in a bore in the tip 1 of the projectile, the axis of this bore extending perpendicularly to the longitudinal axis of the projectile. This bore consists of two partial sections, the partial section on the outside of the projectile accommodating the head of the locking pin while the bore section on the inside of the projectile, having a smaller diameter, accommodates the cylindrical portion of the locking pin in a sealing fashion. The larger bore on the outside of the projectile is deeper, in this arrangement, than required for housing the head of the locking pin. Thereby, a cavity 12 is formed behind the head of the locking pin; i.e., on the side of the pin located in the interior of the projectile.

The cavity 12 is in communication, via a bore, with a propelling charge 14, this bore being worked into the tip 1 of the projectile in parallel, but offset, with respect to the longitudinal projectile axis; in other words, the bore is located perpendicularly to the axis of the locking pin. A pyrotechnical delay charge 10 is located above the propelling charge 14; a lead charge 9 is located above the delay charge. The lead charge 9, the delay charge 10, and the propelling charge 14 are inserted together in a cylindrical sleeve.

In diameterical opposition to this first, laterally offset bore, a second bore, likewise offset laterally, is worked into the tip 1 of the projectile in parallel to the longitudinal axis of the projectile. This bore is fashioned as a blind hole, a striker pin 6 for the primer cap being arranged essentially at the lower closed end of the bore. A spring 13 is seated on the striker pin 6, supporting the primer cap with booster charge 7 for the delay action, arranged thereabove. The primer cap with booster charge 7 is disposed in a sleeve displaceable in the bore against the force of the spring 13.

A head member 11 is inserted in the front end of the tip 1 of the projectile. The head member 11 exhibits an annular recess at its lower end on the inside of the projectile; this recess lies directly above the bores for the lead charge 9 and the subsequent components, as well as above the booster charge 7 with the subsequent components. On account of this transmission channel, there is thus a flow connection between the top end of the booster charge 7 as well as the top end of the lead charge 9.

The arming delay safety mechanism described herein functions as follows: On account of the firing impulse of the propellant charge of the training projectile, the primer cap with booster charge 7, movable against the force of the spring 13, hits the striker pin 6 and is initiated or activated by the latter. The flame of the booster charge 7 on the outlet side passes through the transmission channel 8 and hits the inlet side of the diametrically opposite delay path and/or the lead charge 9. The lead charge 9 is thereby ignited and ignites the delay charge 10. After the latter has been deflagrated, the propelling charge 14 is ignited. The gases developed thereby flow into the cavity 12 and eject the piston-shaped locking pin 5. This ejection thus takes place only after the delay charge 10 has been burnt up. By suitable measures, the deflagration period is selected so that the projectile is already in its free flight path; i.e., outside of the danger zone for the firing team. After driving out the locking pin 5, the impact fuse 3,4 is in the armed condition and can ignite the active charge 2 when hitting the target.

The spring 13, supporting the primer cap with booster charge 7 against the striker pin 6, is dimensioned so that ignition of the arming delay system is possible only by the relatively strong firing impulse of the projectile. However, as long as the projectile is located in the central barrel of the full-caliber dummy projectile, no arming of the active charge fuze can take place even in case of misfiring of the primer cap and thus pressure generation by the propelling charge 14, because the locking pin cannot be ejected; i.e., the pin is held in position by the inner wall of the barrel of the full-caliber dummy projectile.

The arming delay safety mechanism can, of course, be utilized not only in training cartridges for mortars, but rather represents also a quite general and inexpensive solution in cases wherein other arming delay safety means are too expensive or do not appear practicable for other reasons.

What is claimed is:

1. An arming delay mechanism for training ammunition, fired through the central barrel of a full-caliber dummy projectile, which comprises a fuze which, upon impact of the training ammunition on a target, is movable to an operative position where the fuze ignites an active charge, a locking pin ejectable perpendicular to an access of the training ammunition, said pin fixing the fuze in an inoperative position at least as long as the training ammunition is located within the barrel; said locking pin being inserted, ejectable by gas pressure, in a cavity which is in communication with a propelling charge; and the propelling charge being connected to an ignition system operating with delay, said system being initiated upon firing of the training ammunition; said ignition system comprising an igniting charge and a striker pin located in a first bore extending parallel and offset from longitudinal axis of the training ammunition, a delay charge and the propelling charge located in a second bore arranged in parallel to the axis and offset diametrically from the first bore, and channel means for placing the first bore in communication with the second bore.

2. An arming delay mechanism according to claim 1, wherein said delay charge comprises a pyrotechnical delay charge.

3. An arming delay mechanism according to claim 2, wherein a lead charge is arranged in the second bore in front of the delay charge, said lead charge being ignited by the igniting charge comprising a primer cap operatively associated with a booster charge, said ignition being initiated by movement of the booster charge due to firing acceleration of the training ammunition against the striker pin.

4. An arming delay mechanism according to claim 3, wherein the primer cap with booster charge are arranged to be movable in a direction toward the striker pin against the force of a spring, and said channel means including an annular channel leading to the second bore containing the lead charge.

5. An arming delay mechanism according to claim 4, wherein the locking pin, the propelling charge, the delay charge and the lead charge are arranged on one side of the axis of the training ammunition, and the primer cap with booster charge, spring, and the striker pin are arranged on the other side of the axis.

6. An arming delay mechanism according to claim 5 wherein the annular duct is located within a head member located at a forward end of the training ammunition.

7. An arming delay mechanism according to claim 1 wherein the locking pin and the striker pin are located diametrically opposed from each other.

8. An arming delay mechanism according to claim 1 wherein the fuze and an operatively associated striker pin are located coaxial with the axis of the training ammunition, said associated striker pin being biased away from said fuze by a spring.

* * * * *